United States Patent [19]

Gregg

[11] 4,244,086

[45] Jan. 13, 1981

[54] ZIPPER CLOSURE LOCK

[75] Inventor: James S. Gregg, Aurora, Colo.

[73] Assignee: Samsonite Corporation, Denver, Colo.

[21] Appl. No.: 76,961

[22] Filed: Sep. 20, 1979

[51] Int. Cl.[3] ..... A44B 19/26

[52] U.S. Cl. ..... 24/205.11 L; 70/68; 24/205.14 R

[58] Field of Search ..... 24/205 R, 205.11 L, 24/205.14 R, 205.15 R; 70/68; 190/41 Z

[56] References Cited

U.S. PATENT DOCUMENTS

| | | | |
|---|---|---|---|
| 2,569,076 | 9/1951 | Schaye | 24/205.11 L X |
| 2,621,387 | 12/1952 | Williams | 24/205.15 R |
| 3,335,586 | 8/1967 | Levine et al. | 70/68 |
| 3,978,697 | 9/1976 | Bako | 70/68 |
| 4,031,723 | 6/1977 | Samhammer et al. | 70/68 |
| 4,081,882 | 4/1978 | Toepelt et al. | 24/205.11 L X |
| 4,123,829 | 11/1978 | Takabatake | 24/205.11 L X |

FOREIGN PATENT DOCUMENTS

| | | | |
|---|---|---|---|
| 875306 | 3/1953 | Fed. Rep. of Germany | 70/68 |

*Primary Examiner*—Roy D. Frazier
*Assistant Examiner*—Peter A. Aschenbrenner
*Attorney, Agent, or Firm*—George J. Netter

[57] ABSTRACT

A locking member is secured permanently to one zipper operator as a pull tab and is selectively positionable onto a second pull tab of another zipper operator when the two are located in juxtaposition. A rod-like detent within the locking member is movable under the selective control of a finger actuated member to pass into a loop on the second zipper operator locking the two operators together. A lock is provided actuatable by a key for securing the detent within the loop on the second pull tab and maintaining the zipper closed until affirmatively unlocked and released.

5 Claims, 6 Drawing Figures

ZIPPER CLOSURE LOCK

The present invention relates generally to a zipper closure lock and, more particularly, to a means for releasably securing the zipper pull tabs on a zipper closure to one another.

It is a usual practice in certain types of luggage, for example, to have a zipper closure, or just zipper, in which a pair of zipper pull tabs can operate on the same zipper with the tabs being located immediately adjacent one another when the zipper is fully closed. In order to prevent the zipper pull tabs from being inadvertently separated from one another allowing contents of the luggage to be removed, it is desirable that some means be provided for releasably securing the pull tabs together and thus maintaining the case in a closed condition. Although the described invention may be usefully employed in any context where a pair of zippers are used to releasably secure two members together, it is especially advantageous for use with so-called softside luggage, garment bags or other similar luggage items.

OBJECT AND SUMMARY

It is therefore a primary object of this invention to provide a locking member which is secured permanently to one zipper operator as a pull tab and which is selectively positionable onto a second pull tab of the other zipper operator when the two are located in juxtaposition. More particularly, a rod-like means within the locking member is movable under the selective control of a finger actuated member to pass into a loop on the second zipper operator thereby locking the two operators together. A lock is provided actuatable by a key for securing the rod-like member within the loop on the second pull tab and maintaining the zipper closed until affirmatively unlocked and released.

DESCRIPTION OF A PREFERRED EMBODIMENT

Figure 1:
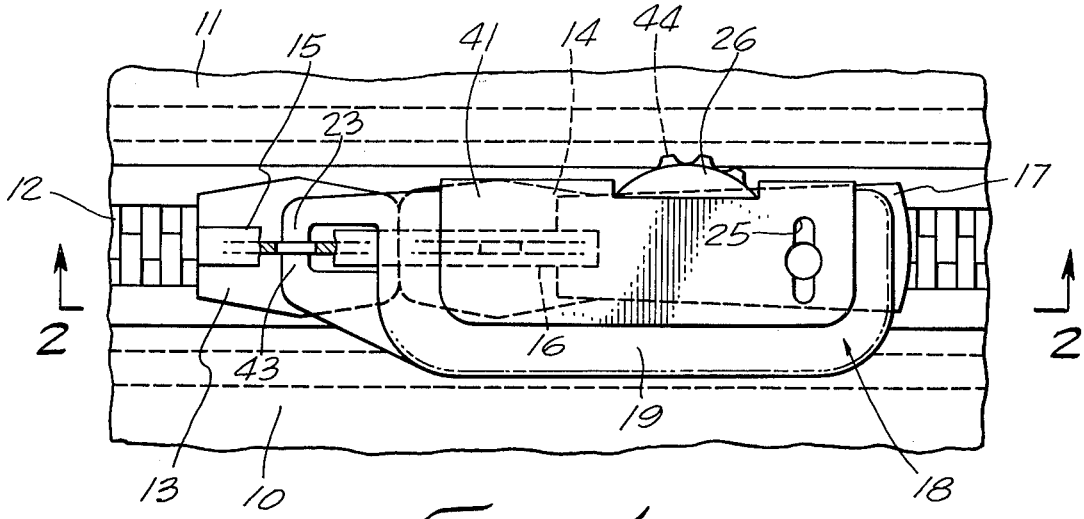
FIG. 1 is a plan view of the pull-tab and locking member shown operatively related to two zipper closures.
Figure 2:
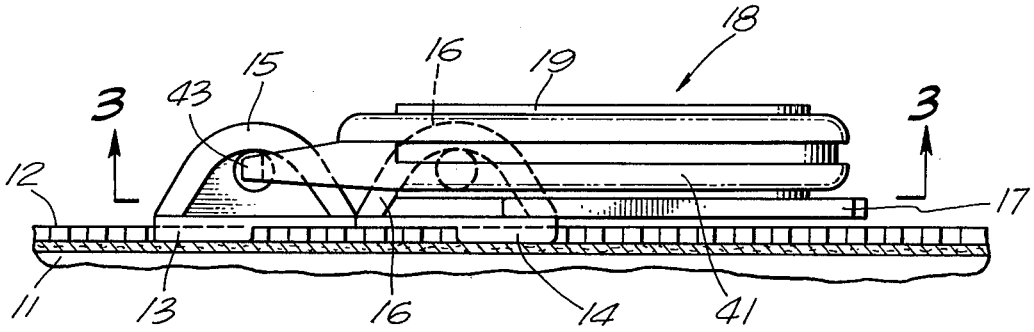
FIG. 2 is a side elevational view taken along the line 2—2 of FIG. 1.

Turning now to both FIGS. 1 and 2, a pair of members 10 and 11 (e.g., softside luggage halves) are shown joined together at facing edges by a zipper 12 which in the special form to which the present invention achieves its most advantageous action is one having two zipper operators 13 and 14, which when the zipper is fully closed are immediately adjacent one another. To open the zipper, optionally one of the operators 13 or 14 may be moved away from the other, or both of them may be moved away from each other. Although the invention to be described is especially advantageous for use on so-called softside luggage having its major parts joined by a zipper, the invention can also be utilized wherever a double-operator zipper is employed, namely, on clothing, garment bags, or a wide variety of other products.

Each operator 13 and 14 includes an upstanding loop 15 and 16, respectively. The loop 16 has a pull tab 17 made of flat metal and, in the conventional manner, is swivelly connected to the loop 16 so that the tab may be rotated in a vertical plane to the zipper closure, from a first position lying on the zipper operator 14 (FIG. 2) to a position 180 degrees therefrom. The pull tab is used in the normal way to enable pulling of the operator 14 along the zipper to a desired location.

The other loop 15 is interconnected with the pull tab and locking means 18 to be described. Without reference to details, the pull tab and locking device 18 is swivelly connected to the loop 15 so that it may be arranged throughout a range of angular relationships to the closure and used in the same way that the tab 17 is. Also, in a way that will be more particularly described, the means 18 can be located over and onto the loop 16 in locking relationship preventing the two loops 15 and 16 and their respective operators 13 and 14 from being separated whereby the zipper closure is maintained locked and closed.

Figure 4:
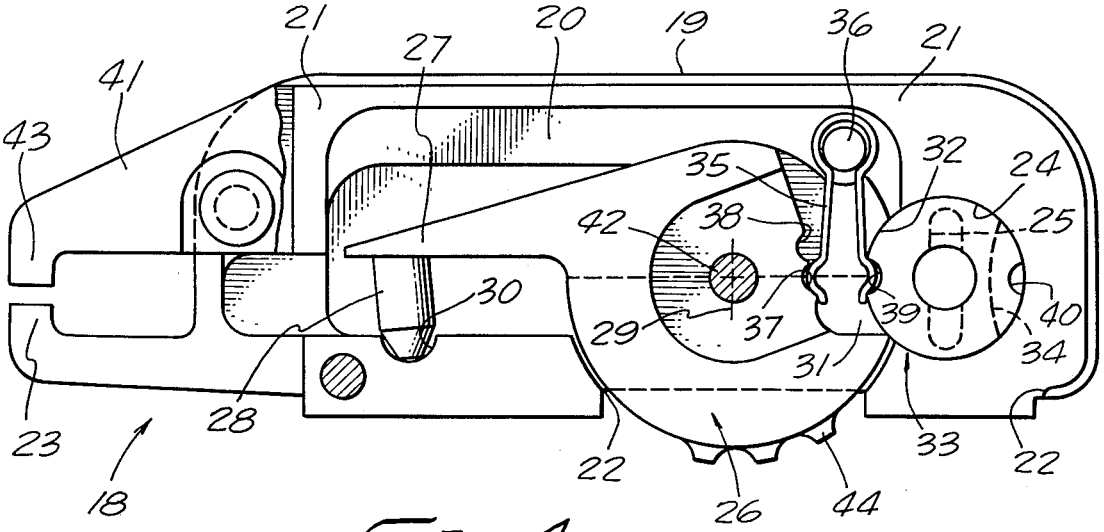
FIG. 4 is a plan sectional view similar to FIG. 3 showing internal construction in locking mode.

Turning now to FIG. 4, the means 18 includes a first open shell body member 19 of generally elongated rectangular shape having a central cavity 20 and an upstanding wall 21 extending peripherally about the cavity 20 except for the open area 22 along one side. One end of the member extends longitudinally outwardly into a generally C-shaped hook 23 for a purpose to be described. A shallow circular declivity 24 is formed in the wall 21 with an included slotted opening 25 extending completely through the body wall.

A rotor 26 of substantially disk-like construction includes an arm 27 tangentially extending therefrom. A cylindrical locking detent 28 is an integral part of the arm 27 and is moved about a circular path as the rotor 26 revolves about its central axle 29 which is rotatably received within a suitable opening in body member 19. The beveled tip of the detent 28 is received within a shallow groove 30 in the wall 21 of the body member 19 when the rotor is rotated to its counterclockwise maximum position as shown in FIG. 4.

The peripheral side edge of the rotor opposite that carrying the arm 27 has a thinned-down portion 31 of reduced thickness along the direction parallel to the axle 29. This reduced thickness part of the rotor also includes a circular cut-out portion 32 which coincides with and is a continuation of the circular opening 24 when the rotor is positioned at its counterclockwise maximum as in FIG. 4.

A locking cylinder 33 is of such dimensions as to permit rotatable receipt within the opening 23. The lower end of the cylinder 33 received within 23 has a side portion 34 which is removed (shown by the dotted lines) and of such geometry that when the cylinder is suitably rotated the removed portion 34 on facing the rotor as in FIG. 5, allows the rotor to move freely therepast. On the other hand, when the removed portion 34 faces away from the rotor 26 as in FIG. 4, then the solid part of cylinder 33 is received within the rotor opening 32 and prevents the rotor from being turned in either direction and in that way maintains the detent 28 fully within the shallow groove 29, or in the locked mode.

A generally U-shaped leaf spring 35 has its cross-bar formed somewhat circularly for retention on a stanchion 36 affixed to the shell member 19 in the cavity 20 outwardly of the path of rotor movement. The spring arms are formed adjacent their outer ends into rounded protuberances which are received within grooves 37 and 38 in the side of the rotor and grooves 39,40 in the locking cylinder 33, respectively. In this manner, both the rotor and locking cylinder are positively positioned in both the released and locked or locking modes.

A cover shell 41 is secured onto the first shell 19 via a post 42, the two forming a housing for the device 18. The shell 41 has an externally extending hook 43 which cooperates with hook 23 to provide swiveling engagement of the device 18 with the loop 15.

Figure 3:
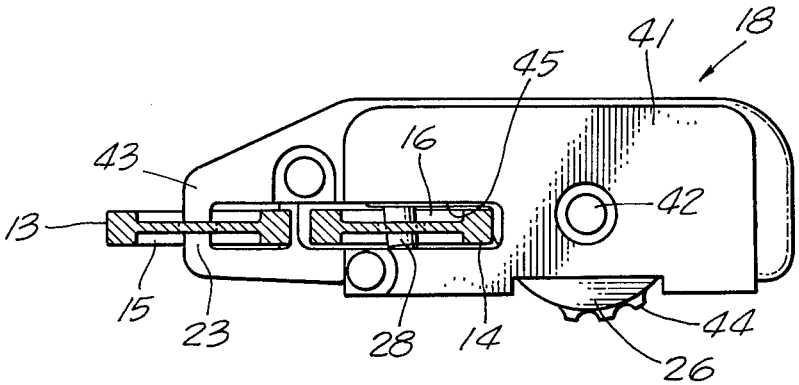
FIG. 3 is a plan sectional view taken along the line 3—3 of FIG. 2.
Figure 5:
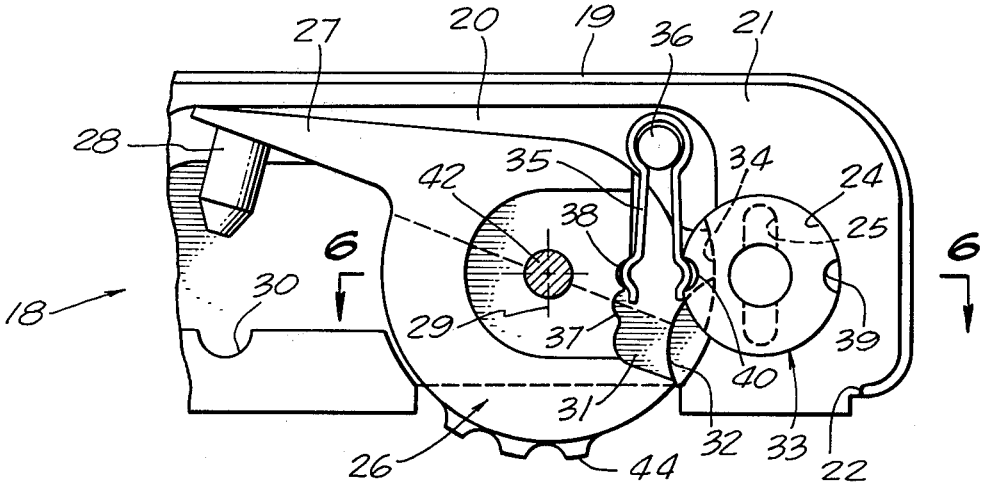
FIG. 5 is a plan sectional view similar to FIG. 4 only showing the locking member in released mode.
Figure 6:
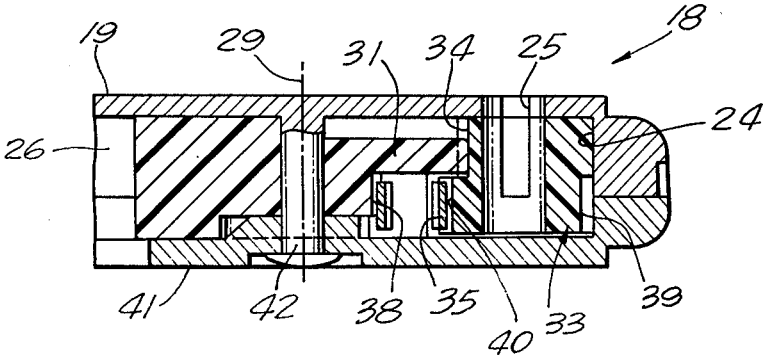
FIG. 6 is a sectional elevational view taken along the line 6—6 of FIG. 5.

For the ensuing discussion of operation, assume the zipper operators 13 and 14 are separated along the zipper closure and the rotor 26 and locking cylinder 33 are released as in FIG. 5. Next, the two operators are moved into juxtaposition by either simultaneously gripping both the pull tab and locking device 18 and pull tab 17 and pulling them together, or by pulling either one toward the other. When this is accomplished, the rotor 26 is actuated (protrusions 44 assist finger manipulation) to place the device 18 in the released or open position as in FIG. 5. When the device 18 is rotated over and onto the loop 16 (FIGS. 2 and 3) with the loop passing through an elongated slot 45 in the cover shell 41. Manipulation of the rotor to the position shown in FIG. 4 moves the cylindrical detent 28 through the loop 16 locking the two loops and associated operators together.

If it is desired, the locking cylinder may be rotated to the obstructing position shown in FIG. 4 which prevents rotating the rotor to the open position until cylinder 33 is once again set to the non-obstructing or released position. Locking and unlocking of the cylinder 33 is accomplished by inserting a key through slotted opening 25 in the shell 19 into cylinder 33 and rotating the same in the requisite direction.

There is provided in accordance with the described invention, a device for releasably securing first and second zipper operators together which device can be selectively locked in its securing position.

I claim:

1. A device for selectively securing first and second zipper operators together, each operator having an upstanding loop, comprising:

a hollow housing swivelly connected to one loop, and having an opening for receipt onto the other loop at one position;

a rotor located within said housing and having peripheral parts extending through a further opening in said housing;

a detent on said rotor which extends through said other loop at one position of said rotor and is free of said loop for other rotor positions; and means selectively adjustable to obstruct rotation of said rotor from the position at which the detent is within the loop to a position free of said loop.

2. A device as in claim 1, in which the rotor includes first and second notches on a peripheral surface thereof, and a leaf spring within said housing has a part which resiliently engages one notch when the detent extends through said loop and engages the other notch when the detent is free of said loop.

3. A device as in either of claims 1 or 2, in which the obstructing means includes a cylindrical member having part of its periphery removed, and said cylindrical member is selectively rotatable from a position where the member periphery lies in the path of movement of said rotor obstructing rotor movement, to a position where said member removed portion lies in the path of movement of said rotor thereby enabling rotor movement.

4. A device as in claim 1, in which said housing is formed of two shell-like members closed onto each other and having first and second hooks cooperating to form a swivel connection to the first recited operator loop.

5. A device as in claim 1, in which the obstructing means has first and second notches diametrically opposed on the means periphery, and spring means having parts thereof which are resiliently within the notches as said means is moved therepast thereby positively positioning said means.

* * * * *